United States Patent [19]

Abbott

[11] 4,162,645

[45] Jul. 31, 1979

[54] METHOD OF MAKING A CARTRIDGE

[75] Inventor: David D. Abbott, Baltimore County, Md.

[73] Assignee: AAI Corporation, Cockeysville, Md.

[21] Appl. No.: 743,390

[22] Filed: Nov. 19, 1976

Related U.S. Application Data

[63] Continuation of Ser. No. 495,720, Aug. 6, 1974, abandoned, which is a continuation of Ser. No. 313,004, Dec. 7, 1972, abandoned, which is a continuation of Ser. No. 13,066, Feb. 20, 1970, abandoned.

[51] Int. Cl.[2] ..... F42B 33/10

[52] U.S. Cl. ..... 86/23; 86/31; 86/39

[58] Field of Search ..... 102/38, 39, 40, 42 R, 102/42 C, 43 R; 86/1 R, 20 R, 23, 24, 25, 26, 27, 28, 29, 30, 31, 32, 33, 39, 40, 41; 141/100, 101, 103, 104

[56] References Cited

U.S. PATENT DOCUMENTS

| | | | |
|---|---|---|---|
| 34,615 | 3/1862 | Shannon | 102/40 |
| 2,099,252 | 11/1937 | Bagby | 141/100 X |
| 2,232,634 | 2/1941 | Roberts et al. | 102/43 C |
| 3,062,144 | 11/1962 | Hori et al. | 102/38 |
| 3,087,428 | 4/1963 | Frech, Jr. | 102/39 |
| 3,113,483 | 12/1963 | Puth | 86/23 |
| 3,115,835 | 12/1963 | Currie | 102/42 R |
| 3,446,146 | 5/1969 | Stadler | 102/45 |
| 3,645,207 | 2/1922 | Daniels | 102/40 |

FOREIGN PATENT DOCUMENTS

| | | | |
|---|---|---|---|
| 742028 | 12/1955 | United Kingdom | 102/39 |

*Primary Examiner*—Harold J. Tudor
*Attorney, Agent, or Firm*—Reginald F. Pippin, Jr.

[57] ABSTRACT

A method of making a cartridge, in particular a blank or propellant gas cartridge which has a casing of generally tubular form with a telescopically reverse in-folded star-crimp-closed integral tubular end section, and within which is contained a blank propellant powder charge, with a readily rupturable wad of low heat conductivity initial restraining mass formed between the propellant powder charge and the in-folded telescoping star-crimp-closed end of the casing, in which method the cartridge is formed by front loading a propellant charge and the low-heat-conductivity wad, and then star-crimping and telescopically reverse in-rolling the cartridge casing, after which the recessed in-rolled star-crimped casing is heat sealed.

14 Claims, 13 Drawing Figures

METHOD OF MAKING A CARTRIDGE

This application is a continuation of copending application Ser. No. 495,720, filed Aug. 6, 1974, which in turn is a continuation of application Ser. No. 313,004, filed Dec. 7, 1972, which in turn is a continuation of application Ser. No. 13,066, filed Feb. 20, 1970, all now abandoned.

This invention relates to a method of making a cartridge, in particular a blank or propellant gas cartridge.

It has been conventional practice in the art of blank cartridges or propellant gas cartridges to provide cartridges which might be employed in standard shotguns. In providing such blank cartridges it is desirable that a propellant charge be employed which is of the smokeless type, as a full propellant charge of black powder has many disadvantages, including the formation of substantial smoke, highly corrosive gases, and solid residues. Such smokeless powder normally requires the containment thereof under a pressure substantially in excess of atmospheric pressure, e.g. several hundred psi or more, in order to maintain and complete burning after initial ignition. In prior blank cartridges the desired propellant pressure has been maintained by restraining the propellant within the shotgun shell through the medium of a large quantity of cardboard discs, commonly known as wads, in front of the propellant charge. Such cardboard wads achieve the desired restraining and propellant self-pressurizing function, but result in a substantial disadvantage in that the expulsion of the wads from the gun bore is often essentially as an intact wad mass at high velocity, and of effectively substantial unit inertial mass, thereby providing a hazardous high velocity projectile of sufficient inertial mass to inflict serious injury on a person. In addition, such large mass and size projectiles are undesirable when the blank cartridge is used in some important gas propellant use devices, such as in projectile launchers which embody lateral gas port chambers, as in U.S. Pat. No. 3,318,033, as the relatively large size cardboard wads, which are also relatively tough and difficult to break up into pieces, tend to clog the relatively smaller lateral gas ports very rapidly and may well result in dangerous malfunction of the firing weapon. In a further prior blank cartridge, an attempt has been made to overcome the cardboard wad projectile problem by forming the cartridge case of a closed cylindrical brass body which, due to its rupture strength, contains the propellant and propellant gases during burning up to a given rupture pressure, and thereafter ruptures to release the propellant gases. This latter metal cartridge case blank cartridge has the substantial disadvantage of causing the formation of sharp edges along the zone of rupture of the cartridge body after bursting at the integral closed forward end, and in addition is relatively high in cost of manufacture, particularly relative to the cost of manufacture of the cardboard wad construction which employs standard shotgun cardboard shell casings.

It is an object and feature of the present invention to provide a simple and effective method of making relatively inexpensive cartridges of the blank or gas propulsion type, and particularly which may be employed in gas propulsion launching arrangements which have restricted gas ports therein, such as in U.S. Pat. No. 3,318,033.

Still a further object is the provision of a method of making a simple and inexpensive cartridge which enables the employment of smokeless propellant powder without the necessity for either a metal retaining casing body or the conventional multiple cardboard discs, and which employs a restraining construction which is itself effective in pressure retention while enabling a high degree of frangible comminution of the expelled portion thereof during and after expulsion from the cartridge casing.

Still other objects, features and attendant advantages will become apparent to those skilled in the art from a reading of the following detailed description of a preferred embodiment constructed according to the invention, taken in conjunction with the accompanying drawing wherein.

Figure 1:
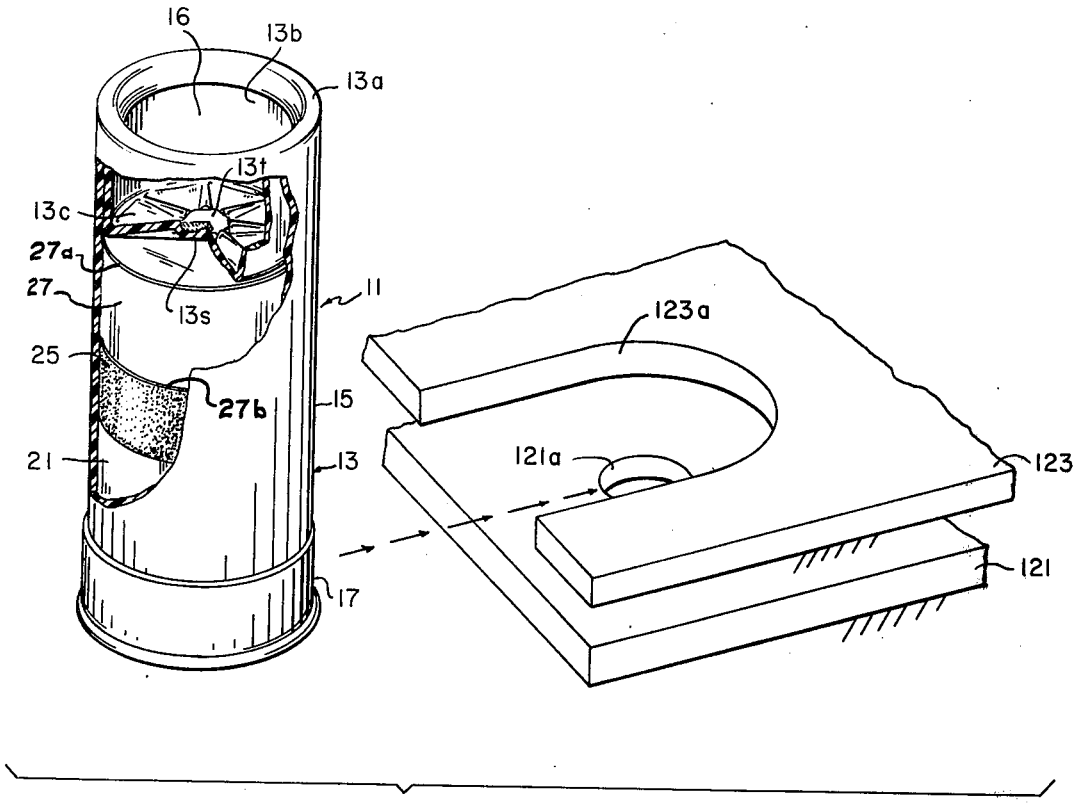
FIG. 1 is an exploded perspective view of a cartridge with a base holder employed in making the cartridge.

Referring now in detail to the figures of the drawing, in a preferred mode of practice of the invention a cartridge 11 is formed, including a case 13 which may be formed with a base cup 17 of metal, such as brass, a body tube 15 frictionally joined to and within the base cup 17 as by crimping of the base cup 17 about the body tube 15, and a stationary base plug 21 contained within the body tube 15. The base plug 21 may be formed of a single molded mass of thermosetting or thermoplastic plastic, such as polyethylene, hard rubber, or the like, or may be a composite laminated mass, as may be desired, Body tube 15 is preferably crimped about the base cup end of the base plug 21 as indicated at **15*a*, and in order to inexpensively and effectively seal the junction between the base plug 21 and the case 13 the base plug is formed with an annular obturating flange 21*a* facing the propellant charge chamber of the cartridge. Alternatively, base plug 21 and body tube 15 and/or base cup 17** may be formed as a single integral molded mass of suitable material such as polyethylene or polypropylene.

Base plug 21 has an axial bore formed therethrough, into which may extend an internal base cup nipple **17*a*, and within which is press fit a primer 19, which may suitably be a standard percussion primer. The forward end of the bore 21*a* in base plug 21 is filled with a suitable ignition charge 23, which may suitably be conventional black powder, and which serves to ignite the main propellant charge 25 which is disposed within a cavity or chamber formed between the forward obturating face of base plug 21 and the rear facing face of a frangible restraining wad 27 of special construction. The main propellant charge may be and is preferably a standard blank powder charge, of the type which requires a constraining pressure substantially above atmospheric pressure, as of the order of several hundred psi of more, for sustained burning after initial ignition by the ignition charge 23, and which type of propellant charge is generally termed as smokeless. Various charges 25 are available for this purpose, dependent upon whether the charge is to be used for gas propellant purposes or merely as a blank for audio simulation purposes, or some combination or other use thereof. In the instance of utilization of the invention for propellant purposes primarily, I have found that a main propellant charge 25** of standard blank powder, conventionally identified as WC Blank and manufactured by Olin Mathieson Chemical Corporation, is satisfactory, employing 18.5 grains thereof, with an ignition charge of 1.5 grains of fine black powder.

The constraining wad 27 in the preferred embodiment is of a special construction being a composite disc wad formed of discrete small particles of cork bonded together in a generally cylindrical mass by a suitable relatively low bond adhesive, such as paraffin, the wad disc preferably having relatively low strength thin paper sheet coverings at its forward and rearward ends, as indicated at 27*a* and 27 *b* respectively, for purposes of initial ease of handling and cartridge assembly without breaking or rupturing. A commercially available material which I have found to be suitable for forming the low-tensile, low-mass, low-heat conductivity soft particulate wad disc 27, is Sacork, which I have found usable in thicknesses of from approximately $\frac{3}{8}''$–$\frac{1}{2}''$ in 12 gauge cartridge constructions.

Figure 2:
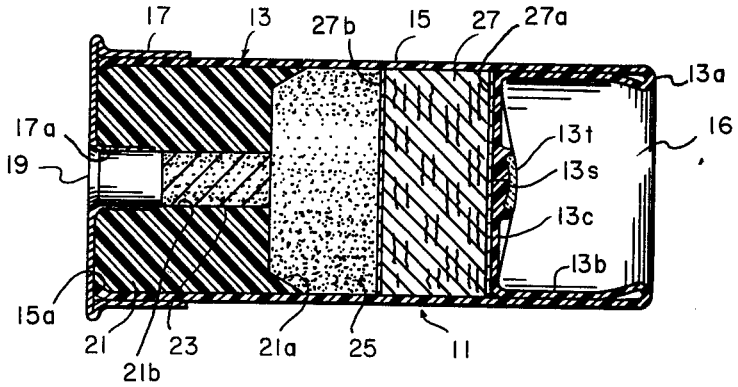
FIG. 2 is a longitudinal section view of the cartridge of FIG. 1.

The cork wad disc 27 has an outside diameter which is complementary to the internal diameter of case body tube 15, and is retained in its initial position as shown in FIGS. 1 and 2, through the medium of a special cooperating constraining construction of the case 13 which enables the otherwise relatively low tensile strength wad to effectively constrain the burning propellant charge sufficiently to enable a desired degree of burning of the charge, while also enabling the low strength wad disc 27 to be subsequently broken apart and expelled from the cartridge in a highly comminuted low mass relatively soft particulate form.

This special cooperating construction of the case 13 for initial constraining reinforcement of the particulate cork wad disc 27 is provided by forming the case 13 with an integral reverse in-folded or in-rolled tube extension 13*b* which connects with the main external longitudinal portion of the case 13 through an annular reverse roll 13*a*, and this reverse tube extension 13*b* is extended into end engagement with and closed across the forward face 27*a* of the cork wad disc 27. A desired structural strength and ease of forming is preferably achieved by forming the lateral closure across the forward face 27*a* of the cork wad disc by a generally radial or star-crimp configuration 13*c*, which is preferably bonded at its center section as by a thermoseal or adhesive bonding thereof, as indicated at 13*s*, and if desired a further seal may be effected for water proofing purposed by a drop of wax 13*t*, such as paraffin. To this end, the body tube 15 of case 13 is preferably formed of a suitable thermoplastic material, such as extruded polyethylene or polypropylene, which enables ease of formation (and desired reverse unrolling in fired operation) of the forward reverse roll and tube extension 13*b*, with star-crimp closure 13*c* and thermoseal 13*s*, as illustrated in the preferred embodiment.

Figures 3, 4, 5, 6, 7:
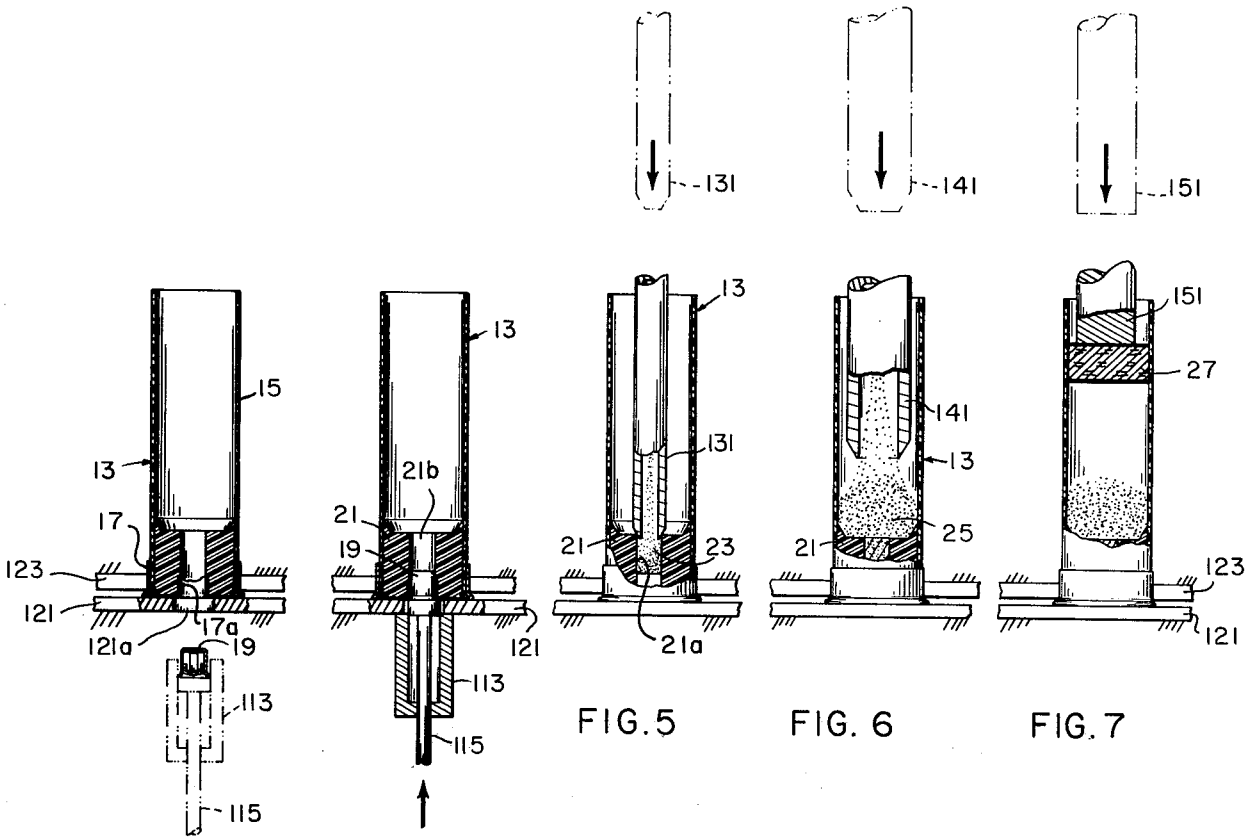
FIGS. 3–13 are schematic elevation partial cut-away views illustrating sequential steps in the manufacture of the cartridge of FIG. 2 according to the invention.

The foregoing described unique cartridge is advantageously manufactured according to the present invention by following the steps as sequentially illustrated in the schematic illustrative views of FIGS. 3–13. A case 13 having a primer base end and an open mouth forward end is removably mounted with its base end enclosed within a base support 121 and a base side mount receiver 123, as by slidably removably inserting case 13 into a complementary receiver side mount slot 123*a*. The slot 123*a* is formed substantially complementary to the corresponding longitudinal outer configuration of the case 13, and the spacing between the base support 121 and slotted receiver 123 is such as to accommodate the rim of the case 13. In the illustrative and preferred embodiment of the cartridge and the practice of the method according to this invention, the case 13 may be suitably preformed with a brass base cup or head 17 having an annular extraction rim formed at its base end, with a body tube of extruded polyethylene, and with a further internal base plug 21, all of which have been preassembled, and which are available as standard shotgun shell cartridge cases. In the first illustrated step as shown in FIG. 3, the case 13 is mounted in the receiver and support arrangement 121, 123, and the bore 21*a*, in base plug 21 is aligned with a primer insertion bore formed in the support 121. The percussion primer 19 is press fit into the base cup nipple 17*a* which extends into the bore 21*a* formed in the base plug 21. This may be readily accomplished by employing a guide cylinder 113 and primer insertion piston 115 which may be brought into mutual co-axial alignment with the primer insertion bore 121*a*, and as shown in the steps illustrated in FIGS. 3 and 4.

The primer loaded case is next loaded with the ignition charge, by gravity drop of the ignition charge 23 through a charge drop tube 131 which is first vertically lowered through the open end of the case 13 and coaxially seated on or brought into close proximity to the open upper bore end of the base plug 21. The ignition charge 23 is thereby disposed within the bore 21*a*, after which the ignition charge tube 131 may be removed, and the propellant charge drop tube 141, of larger diameter, is lowered into the case 13, whereupon the propellant charge 25 is dropped into the lowered end of the case 13. While the steps of FIGS. 5 and 6 are illustrated as sequential steps, such may be performed simultaneously by coaxial placement of the ignition charge drop tube 131 within the propellant charge drop tube 141 and protruding therefrom, with the ignition charge 23 being dropped through the coaxial smaller drop tube 131, and the propellant charge 25 being dropped through the torroidal opening formed between the outer wall of the smaller drop tube 131 and the inner wall of the drop tube 141. By seating the protruding drop tube 131 into contact with the upper bore end of the base plug 21, it will be seen that the ignition charge 23 may thereupon be dropped simultaneously with the dropping of the propellant charge 25, whereupon after removal of the two drop tubes the propellant charge 25 will tend to assume a covering position somewhat as shown in FIG. 6, over and in contact with the effective forward end surface of the ignition charge 23 which has been disposed in the wall formed by bore 21*a* and bottomed by the forward end of percussion primer 19. It will also be seen that in this latter modified method one may first insert the ignition charge if so desired, and thereupon insert the propellant charge, in which event it is not necessary that the ignition charge drop tube 131 be in seated contact with the base plug 21, although such is advantageous and desirable even in this instance for assurance of alignment and full disposition of all ignition charge particles within the bore 21*a*.

Next, as shown in FIG. 7, the cork wad disc 27 is lightly press fit pushed into the upper end of the case 13, by insertion thereof through the open upper end of the case and exerting vertical downward pressure thereon by a wide flat-ended push rod 151. The cork wad disc 27 is retained in this upper inserted position for the carrying forward of the remainder of the steps.

Figures 8, 9, 10, 11, 12, 13:
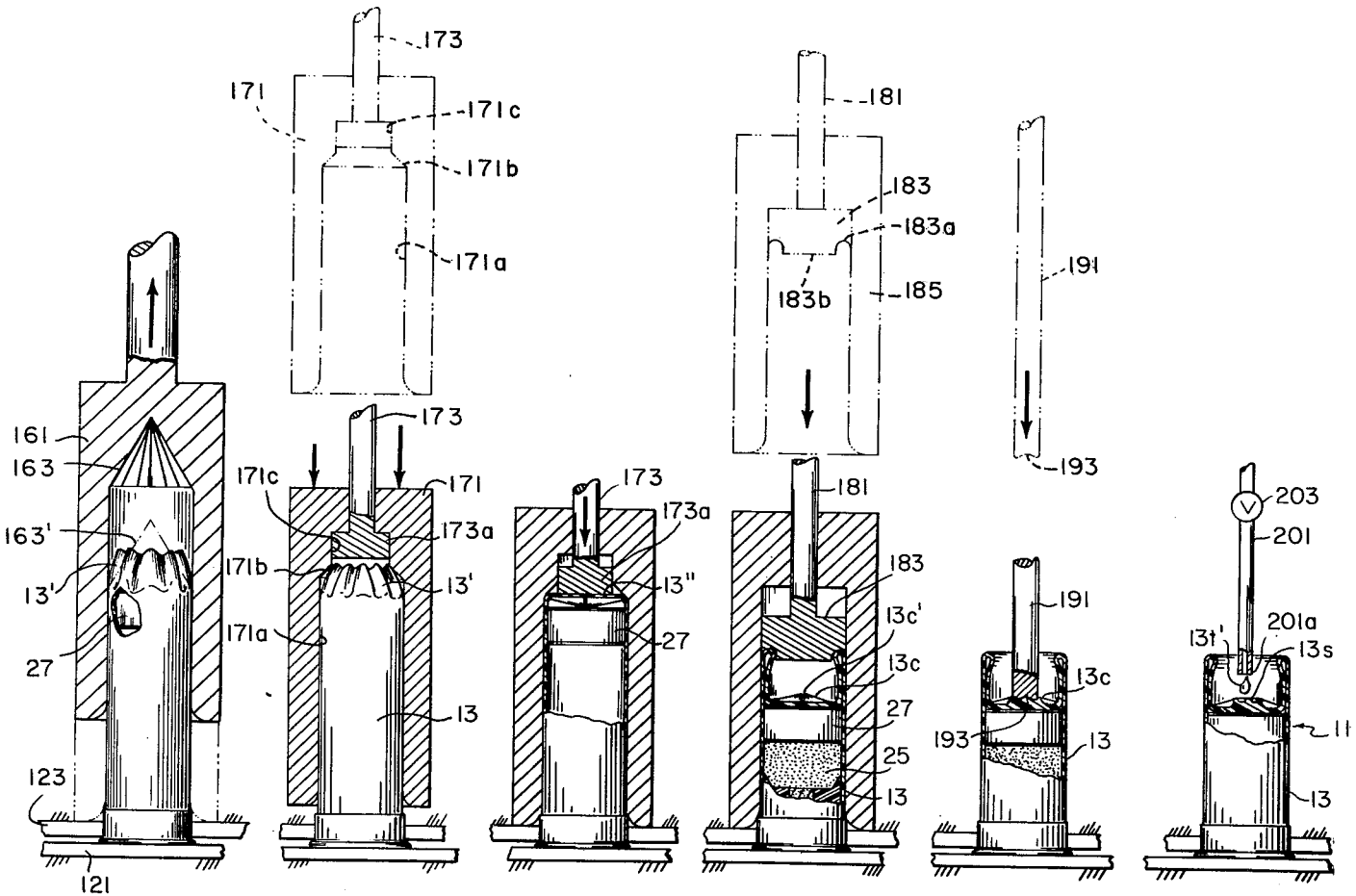

A star-crimp starting tool 161 is next brought into co-axial engagement with the case 13, as shown in FIG. 8, by relative axial motion between the crimp starting tool 161 and the case 13, preferably by downward motion of the crimp starting tool 161 about the case 13. The crimp starting tool 161 has a cylindrical bore slidably freely complementary to the case 13, with a fluted conical surfaced upper end 163. Engagement of the fluted conical surface 163 with the upper open end of the case 13, and further axial motion of the tool 161 downwardly therealong, effects a starting partial star-crimp 13', which is effectively substantially retained in crimped configuration upon axial removal of the starting tool 161 from the case, although there is some degree of elasticity to the plastic material forming the open tube end of the casing 13, which may result in some springing back of the partial star-crimped upper end of the casing. This elasticity may be easily accommodated, as the major crimped configuration is retained, for ease of effecting the further crimping action as illustrated in the step of FIG. 9.

The star-crimp completion tool 171 is next lowered around the case 13, (see FIG. 9) this tool having an inner bore **171*a* at its lower end open and complementary to the case 13 for free sliding movement therealong, the upper end of the bore 171*a* being terminated in a frusto-conical step-down surface 171*b* which engages the partially star-crimped end 13' of the case 13. Downward movement of this star-crimp completion cylinder tool 171 after engagement of the frusto-conical section 171*b* with the partially star-crimped end 13' of the case 13 results in the further inner crimped and in-folding of the star-crimped section 13', although complete in-folding is not thereby readily accomplished. Accordingly, the star-crimp completion tool 171 has also incorporated therewith a piston 173 having an enlarged piston foot 173*a* which engages with the upper further inwardly star-crimped section 13' and press bends such into a full lateral star-crimp as shown at 13" in FIG. 10. In this respect it will be noted that the full lateral star-crimp 13" is brought into substantial axial engagement of its star-crimp folds with the forward or upper surface of the cork wad disc 27 which has been previously inserted and retained in the upper end section of the case 13. In this respect it is of importance to note that the initial positioning of the cork wad disc 27 is such as to dispose its upper or forward-most flat surface at the longitudinal zone which will form the bottom of the lateral star-crimp 13". This assures that the initial partial star-crimp 13' (see FIGS. 8 & 9) amd the intermediate full lateral star-crimp 13", may be successfully formed without further crimping the adjacent lower section of the case 13, as the lateral compressive strength of the cork wad disc is sufficient to prevent such undesired star-crimping of the lower section of the case 13** while crimping the upper open end section thereof.

The star-crimp completion tube 171 is thereupon removed from the case 13, and a case rolling tool including a cylinder 185 and a piston 181, is brought into engagement with the case 13 (FIG. 11). The cylinder 185 has an open mouth lower bore which again is substantially complementary to the outer configuration of the case 13, and the piston 181 has an enlarged foot 183 having an annular rim rolling groove **183*a* formed on the end thereof, with a forwardly protruding center section 183*b*. In bringing the piston 181 and foot 183 into engagement with the lateral star-crimped end section 13" of the configuration of FIG. 10 of case 13, the flat-ended forwardly protruding center section 183*b* first engages the center portion of the star-crimped section 13" and press bends and in-rolls such downwardly and inwardly a short distance to form a beginning forward depression in the case 13 and an in-rolling of the annular side wall of the case. Thereupon, the forward end of the in-rolled annular side wall forms an annular reverse rolled end bend which is seated within the annular rim rolling groove 183*a* of piston foot 183, and the continued downward motion of the piston 181 effects further cold plastic flow reverse in-rolling of the case 13 to form an inner telescopic reverse directed tube portion which connects by the reverse roll end rim section thereof with the outer tubular wall portion of the case 13. This smooth incremental reverse in-rolling of the case 13 is continued by the downward motion of the piston 181 to a predetermined longitudinal position such that the cork wad disc 27 is brought into full engagement with the propellant charge 25, thereby securing the charge in an enclosed chamber such that the charge will not be free to be dislodged and migrate or intermix with the ignition charge 23** during handling of the completed cartridge.

After removal of the piston 181 and cylinder 185, the recessed star-crimped end wall of the case 13 is sealed, preferably by employment of a hot seal rod 191, having a smooth curved peripherally rounded concave end sealing surface 193. Brief engagement of the hot seal rod end 193 with the center section of the star-crimped case end effects melt sealing of the polyethylene case at this interfolded center junction. It is of importance that the hot seal rod not be lowered too far such as to bring it into engagement with the cork wad disc 27, as this would destroy the integrity of the seal formed thereby. However, in the event that the integrity of the seal is either destroyed or the melt seal is not fully effected by the hot seal rod 191, a further step may be performed to further insure the sealing of this star-crimp against penetration of moisture therethrough. To this end, after removal of the hot seal rod 191, a hot wax conduit 201 is lowered to bring its discharge mouth end **201*a* into alignment with the thermosealed center section 13*s* of the recessed star-crimp case section 13*c*, and a valve 203 is opened to enable a small quantity, such as a droplet 13*t'*, or more if desired, of suitable wax, such as paraffin, to be adhered to the thermosealed star-crimp center section 13*s*, as shown in FIG. 13. The cartridge formation is thereupon complete and the cartridge 11 is removed from the receiver and support arrangement 121, 123**.

In respect of the melt sealing of the recessed srar-crimped end **13*c*, *l* as illustrated in FIG 12, it is of importance to note that the multi-purpose cork wad disc 27 serves a further important function in this respect, in that a sufficient heat may be transferred to the star-crimped casing section 13*c* by the hot seal rod 191 to effect melt sealing of the star-crimped end section of case 13, without endangering the ignition of the propellant charge 25, as the cork wad disc 27** serves as a substantial heat barrier in view of its low heat conductivity.

While the invention has been described with respect to a preferred mode of practice thereof, it will be apparent that various modifications and improvements may be made by those skilled in the art without departing from the scope and spirit of the invention. Accordingly, the invention is not to be limited by the specific illustrative embodiment and mode of practice but only by the scope of the appended claims.

That which is claimed is:

1. The method of making a cartridge, comprising holding a dual bore tubular shell casing having two interconnecting bores of respectively a small diameter for an ignition charge and a large diameter for a propellant charge, said casing having a closed base end with a primer therein in effective primer ignition communication with said small diameter bore, and an open mouth forward end, flowing a measured loose granular primer-ignitable ignition charge in laterally guided relation through and past said open mouth and directly into said small diameter bore, flowing a measured loose granular propellant charge through said mouth while holding said casing against intermixing movement, inserting a close-fitting disc wad into said casing to a distance spaced longitudinally inwardly from said open mouth end and longitudinally outwardly from the settled surface of said propellant charge, star-crimping said open mouth end of said casing to a position across said disc wad, reverse-roll-forming the star-crimped said open end by exerting peripheral axial rolling force on the annular peripheral of the star-crimped end of said casing so thereby reverse-roll-form the star-crimped end of said casing and thereby correspondingly axially moving said disc wad downwardly into containing and geometrically stabilizing seated relation with said propellant charge, and thereupon sealing the resulting recessed star-crimped end of said casing.

22. The method according to claim 21, said sealing being effected by heat sealing said recessed star-crimped end at the center thereof by external application thereto of a heated element, said wad being of relatively low heat conductivity and being effective in a triple function role of radially supporting said casing against internal collapse during reverse roll-forming of said casing and resultant axial displacement movement of said wad toward said propellant charge, containing and stabilizing said ignition charge, and also thermally insulating said propellant charge from the heat of said heated element by its final displaced disposition between said star-crimped end and said propellant charge.

23. The method of making a cartridge, comprising holding a tubular shell casing having a closed base end and an open mouth forward end, inserting a propellant charge through said mouth, inserting a close-fitting disc wad into said casing to a distance adjacent and spaced longitudinally inwardly from said open mouth end and longitudinally spaced longitudinally outwardly from the ultimate effective settled and desired contained condition surface of said propellant charge, star-crimping said open mouth end of said casing to a position across said disc wad, reverse-roll-forming the star-crimped said open end by exerting peripheral axial rolling force on the annular peripheral of the star-crimped end of said casing so thereby reverse-roll-form the star-crimped end of said casing and to correspondingly axially move said disc wad downwardly into containing and geometrically stabilizing seated relation with said propellant charge, and thereupon sealing the resulting recessed star-crimped end of said casing.

24. The method according to claim 23, including a position forming said tubular ignition charge holding compartment within said disc wad and in coaxial relationship with and at said small diameter bore during said flowing of said close granular ignition charge.

100. The method according to claim 99, including as simultaneously separately holding said ignition charge and said propellant charge.

111. The method according to claim 100, including sequentially separately loading said ignition charge and said star-crimped charge. C, 12. The method according to claim 7, said close-fitting disc wad being a triple-function heat insulating wad of low heat conductivity, and said sealing of said star-crimped end being effected by heat-sealing of said star-crimped end of said casing.

13. The method of making a cartridge, comprising holding a tubular shell casing, a closed base end and an open mouth forward end, inserting a measured granular ignition charge into said casing through said open mouth, inserting a measured loose granular propellant charge through said mouth, inserting a close-fitting disc wad into said casing to a distance spaced longitudinally inwardly from said open mouth and longitudinally outwardly from the settled surface of said propellant charge, star crimping said open mouth end of said casing to a position across said disc wad, reverse-roll-forming the star-crimped said open end by exerting peripheral axial rolling force on the annular periphery of the star-crimped end of said casing to thereby reverse-roll-form the star-crimped end of said casing and thereby correspondingly axially moving said disc wad downwardly into containing and geometrically stabilizing seated relation with said propellant charge, and thereupon sealing the resulting recessed star-crimped end of said casing.

14. The method according to claim 13, said sealing being effected by heat sealing said recessed star-crimped end at the center thereof by external application thereto of a heated element, said wad being of a relatively low heat conductivity and being effective in a triple function role of radially supporting said casing against internal collapse during reverse-roll-forming of said casing and resultant axial displacement movement of said wad toward said propellant charge, containing and stabilizing said ignition charge, and also thermally insulating said propellant charge from the heat of said heated element by its final displaced disposition between said star-crimped end and said propellant charge.

* * * * *

UNITED STATES PATENT AND TRADEMARK OFFICE

CERTIFICATE OF CORRECTION

PATENT NO. : 4,162,645

DATED : July 31, 1979

INVENTOR(S) : David D. Abbott

It is certified that error appears in the above-identified patent and that said Letters Patent are hereby corrected as shown below:

Column 2, Line 32, change "," to ---.--- ,

Column 2, Line 58, change "of" to ---or--- .

Column 3, Line 47, change "posed" to ---poses--- .

Column 4, Line 10, after "21a" delete "," .

Column 6, Line 46, after "complete" insert ---,--- ,

Column 6, Line 49, change "srar" to ---star--- ,

Column 6, Line 50, after "13c," delete "1" ,

Column 6, Line 55, after "191" insert ---,--- .

Column 9, Line 2, change "star-crimped" to ---propellant--- ,

Column 9, Line 2, after "charge" (second occurrence) delete "C," .

Signed and Sealed this

*Eighteenth* Day of *November 1980*

[SEAL]

*Attest:*

SIDNEY A. DIAMOND

*Attesting Officer*

*Commissioner of Patents and Trademarks*